United States Patent [19]

Lilleker et al.

[11] 4,308,134

[45] Dec. 29, 1981

[54] CYCLONE CLASSIFIERS

[75] Inventors: William H. Lilleker, Agincourt; Dennis V. Williamson, Willowdale, both of Canada

[73] Assignee: Simon-Carves of Canada Ltd., Willowdale, Canada

[21] Appl. No.: 101,475

[22] Filed: Dec. 10, 1979

[51] Int. Cl.[3] ..... B04C 5/16

[52] U.S. Cl. ..... 209/211; 210/512.1

[58] Field of Search ..... 209/211, 144; 210/512 R; 55/459 R

[56] References Cited

U.S. PATENT DOCUMENTS

| | | | |
|---|---|---|---|
| 2,703,273 | 3/1955 | Robertson et al. | 209/211 X |
| 3,887,456 | 6/1975 | Loughner | 209/211 |
| 3,926,787 | 12/1975 | Gay | 209/211 X |

FOREIGN PATENT DOCUMENTS

| | | | |
|---|---|---|---|
| 608026 | 9/1948 | United Kingdom | 209/211 |
| 704132 | 2/1954 | United Kingdom . | |
| 507363 | 4/1976 | U.S.S.R. | 209/211 |

*Primary Examiner*—Ralph J. Hill

*Attorney, Agent, or Firm*—Fetherstonhaugh & Co.

[57] ABSTRACT

A cyclone separator for separating light and heavy fractions of a liquid-borne stream of particles according to the present invention consists of a housing and a cap member to which a vortex finder is fixed for movement with the cap member relative to the housing. The inner end of the vortex finder is disposed within the separator chamber of the housing in a spaced relationship with the discharge passage of the housing and is movable relative to the housing in order to vary the specific gravity of separation of the separator.

2 Claims, 5 Drawing Figures

CYCLONE CLASSIFIERS

This invention relates to cyclone separators. In particular, this invention relates to a cyclone separator in which the adjustable vortex finder is secured with respect to its associated cap such that adjustment movement of the vortex finder does not affect the relative position of the cap and vortex finder.

PRIOR ART

U.S. Pat. No. 3,887,456, dated June 3, 1975, and issued to James W. Loughner, describes a cyclone separator which has an adjustable vortex finder. The adjustable vortex finder is in the form of an overflow tube which is connected directly to a receiver for the light fraction. Loughner has not provided an end cap for receiving the overflow, with the result that the Loughner device is prone to siphoning through the overflow tube.

If a conventional cap was used in conjunction with an adjustable vortex finder of the type taught by Loughner, the raising and lowering of the vortex finder would result in a variation in the clearance between the upper end of the vortex finder and the cap which could adversely affect the efficiency of operation of the cap. As a result, when a cap is to be used to reduce the velocity of the overflow through the vortex finder, it is customary to use either a fixed vortex finder or replaceable vortex finders of different lengths.

We have found that the advantages to be derived from the provision of an adjustable vortex finder can be combined with the advantages to be derived from the use of a discharge cap by securing the vortex finder with respect to the cap in a fixed position while permitting the vortex finder with its associated cap to be adjustably mounted in the main housing of the cyclone separator.

The orifice plate of a cyclone separator is subject to excessive wear in use and in a number of previous separators the orifice plate has been formed separately from the main body of the separator so as to be readily replaceable. The efficiency with which the orifice plate can be removed for replacement is extremely important in minimizing the amount of down time required in the system in which the device is to be used for the purposes of replacing the orifice plate. In the previously referred Loughner reference, it is necessary to release a plurality of threaded bolts to remove the orifice plate. This is a time consuming operation. The orifice plate may be of considerable weight and difficulty may be experienced in attempting to locate the orifice plate in an operative position with respect to the housing and to remove it from the housing.

The difficulties associated with the mounting and release of the orifice plate have been overcome according to the present invention by providing an underlying support system for supporting the orifice plate and moving it to and from a position underlying the main body portion and a position in which the orifice plate can be readily removed from its support.

SUMMARY OF INVENTION

According to one aspect of the present invention, there is provided a cyclone separator for separating light and heavy fractions in a liquid-borne stream of particles comprising a housing having a separator chamber formed therein, an input passage opening into said separator chamber and a first discharge passage opening from said separator chamber for discharging the heavy fraction, a vortex finder having an inner end and an outer end, a second discharge passage opening through said vortex finder between the inner and outer ends thereof for conveying the light fraction from said separator chamber, a cap having a second chamber formed therein and a third discharge passage opening outwardly from said second chamber for discharging the light fraction, said vortex finder being movably mounted in said housing with its inner end disposed within said separator chamber in a spaced relationship with said first discharge passage to form a vortex throat therebetween, said vortex finder being movable relative to said housing to determine the size of said vortex throat, and thereby determine the specific gravity of separation of the separator, said cap being fixed with respect to said vortex finder for movement with said vortex finder relative to said housing when the vortex finder is moved to regulate the specific gravity of separation, said second discharge passage of said vortex finder opening at the outer end thereof into said second chamber of said cap, said second chamber being proportioned and arranged with respect to the outer end of said vortex finder to reduce the velocity of the light fraction before it is discharged through the third discharge passage.

According to a further aspect of the present invention, the housing of the separator described above comprises a main body portion and an orifice plate, quick release clamping means is provided for releasably clamping the orifice plate to the main body portion.

PREFERRED EMBODIMENT

The invention will be more clearly understood after reference to the following detailed specification read in conjunction with the drawings wherein, FIG. 1 is a sectional side view of a cyclone separator according to an embodiment of the present invention;

Figure 1:
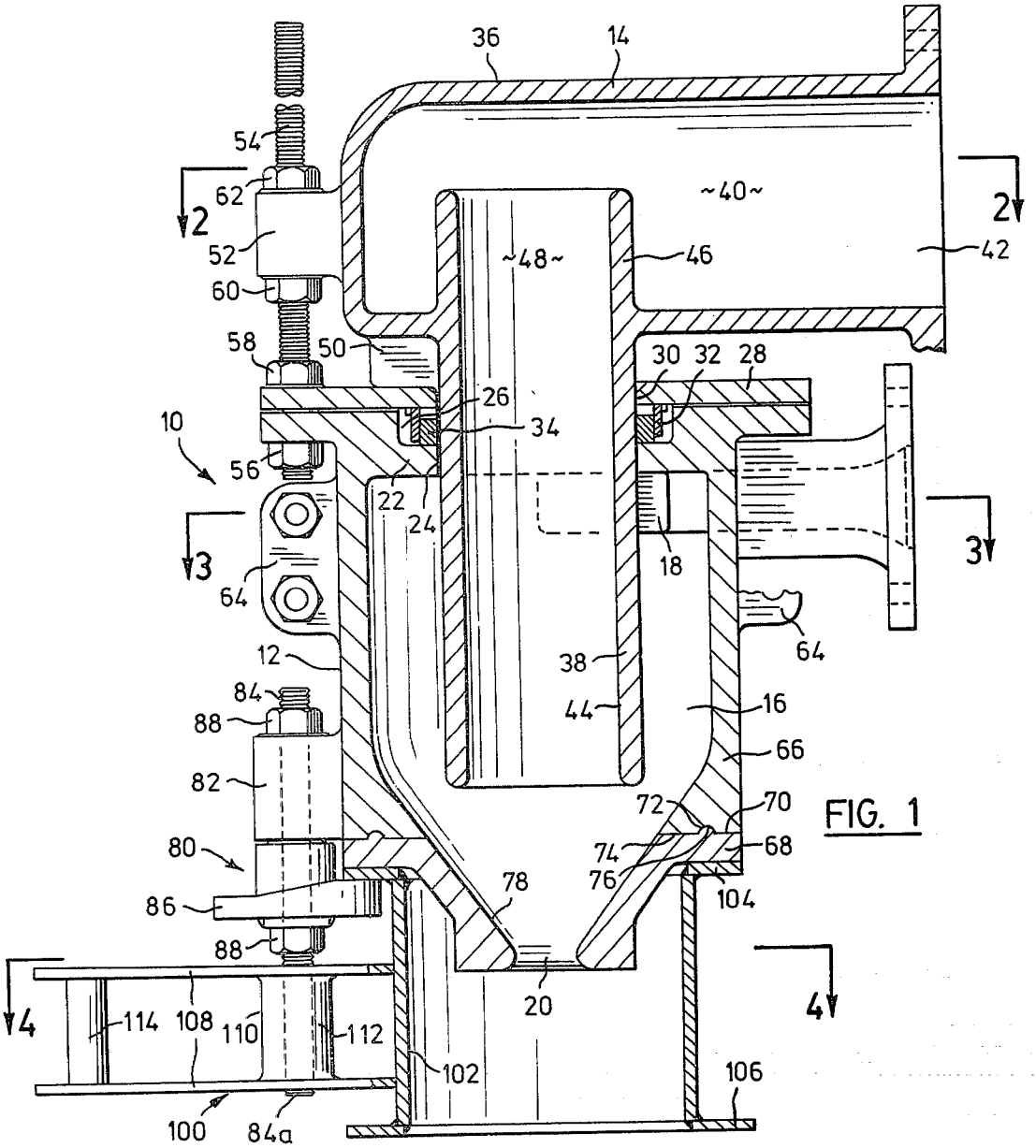
Figure 2:
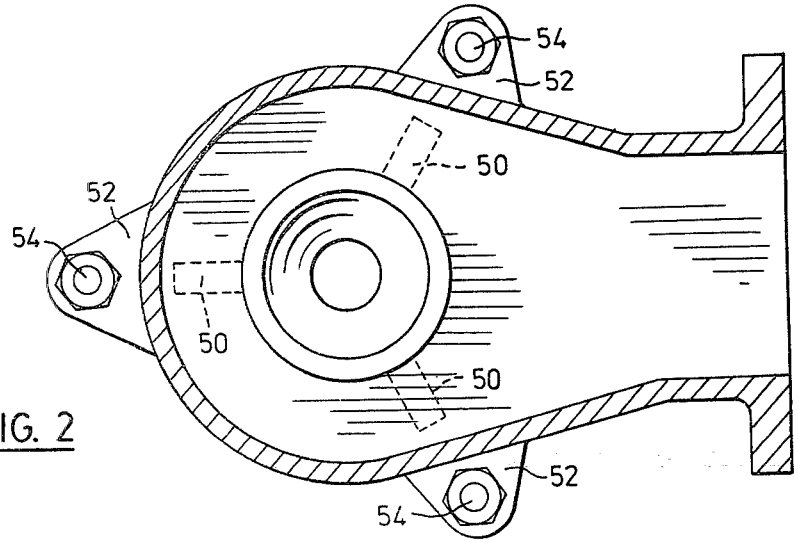
FIG. 2 is a sectional view taken along the line 2—2 of FIG. 1.
Figure 3:
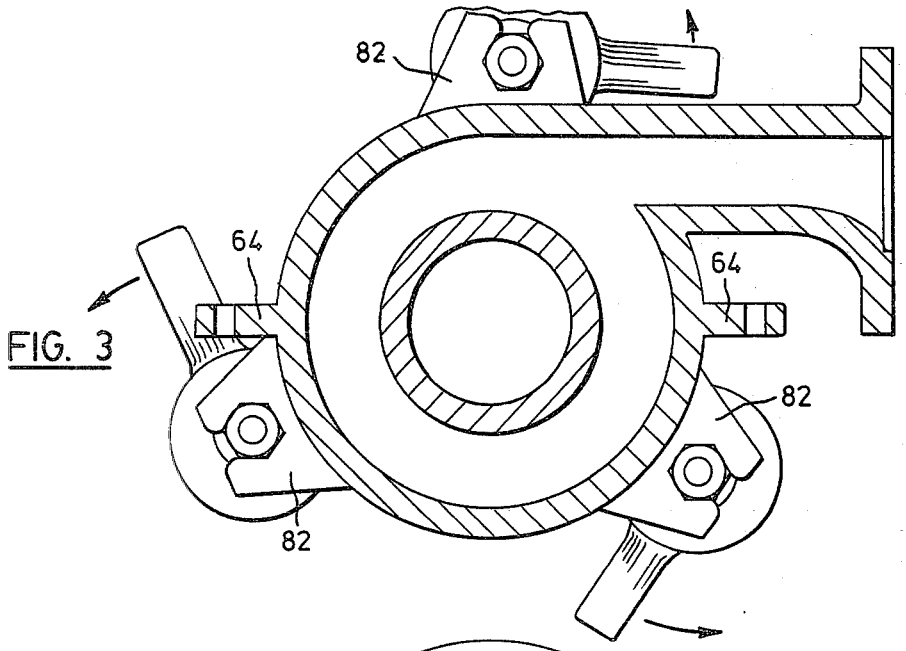
FIG. 3 is a sectional view taken along the line 3—3 of FIG. 1.
Figure 4:
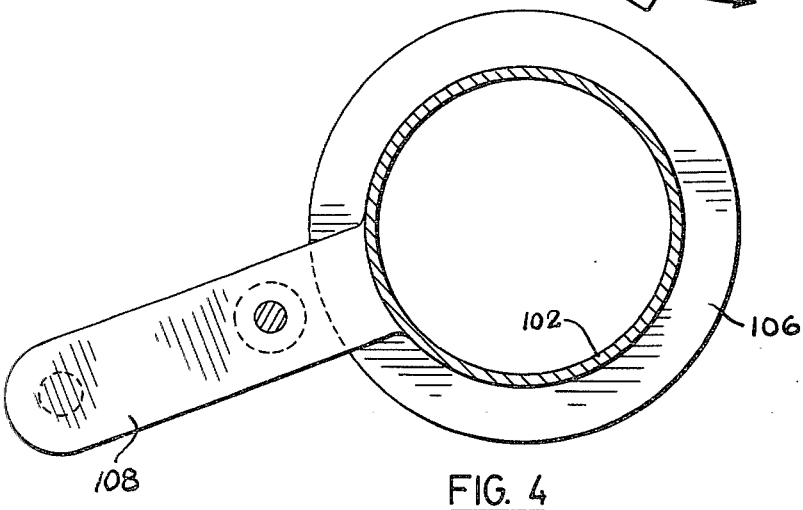
FIG. 4 is a sectional view taken along the line 4—4 of FIG. 1.

With reference to FIG. 1 of the drawings, the reference numeral 10 refers generally to a cyclone separator constructed in accordance with an embodiment of the present invention. The cyclone separator is of the type required for separating light and heavy fractions in a liquid-borne stream of particles. It is particularly suitable for use in separating coal or the like.

The separator 10 consists of a housing 12 and a combined vortex finder and cap, generally identified by the reference numeral 14. The housing 12 has a separator chamber 16 formed therein. An input passage 18 opens into the separator chamber 16 for admitting a stream of liquid to the separator chamber 16 adjacent the upper end thereof. The input passage 18 opens tangentially into the separator chamber 16. A first discharge passage 20 opens downwardly from the separator chamber. The heavy fraction is discharged through the first discharge chamber 20. The housing 12 has an annular shoulder 22 extending radially inwardly at the upper end thereof to a vortex finder passage 24. An annular recess 26 is formed above the shoulder 22. An annular cover plate 28 is mounted at the upper end of the housing 12 and extends radially inwardly to overlie the shoulder 24 and has a bore 30 located centrally thereof. A cylindrical retaining ring 32 is secured as by welding or the like to the underside of the cover plate 28 and extends downwardly therefrom into the recess 26. An annular packing seal 34 is located inwardly from the ring 32.

The combined cap and vortex finder 14 consists of a cap portion 36 and a tubular vortex finder 38. The cap 36 has an expansion chamber 40 formed therein and a discharge passage 46 opening outwardly from the expansion chamber 40. The tubular vortex finder 38 has an inner end portion 44 and an outer end portion 46 and a through passage 48. The outer end portion 46 projects into the expansion chamber 40. The outer end portion 44 projects into the separating chamber 36, through the passage 30 of the cover plate 28 and the passage 24 formed in the housing and through the opening formed in the seal 34. The vortex finder 38 is slidable within the housing so that the inner end thereof may be raised and lowered to vary the specific gravity of separation of the separator. A shoulder 50 is located outwardly from the juncture of the inner end of the vortex finder and the lower face of the cap 14 to form a stop limiting the lowering of the vortex finder by engagement with the retainer plate 28. The cap 14 has three lugs 52 projecting outwardly therefrom. Vortex finder adjustment studs 54 extend through the lugs 52 and through underlying portions of the retaining plate 28 and the housing. Locking nuts 56 and 58 are threaded on the stud 54 and serve to clamp the housing and retainer plate 28 together and to support the studs 54. Adjustment nuts 60 and 62 are threadably mounted on the studs 54 above and below the lugs 52 and serve to provide for the raising and lowering of the vortex finder.

Mounting flanges 64 project laterally from the housing 12 for use in supporting the housing from an appropriate support structure.

The housing 12 consists of a main body portion 66 and an orifice plate 68. The main body portion 66 has an annular end face 70 formed with an annular recess 72. The orifice plate 68 has an annular end face 74 formed with an annular ridge 76 which is proportioned to fit within the annular recess 72. The orifice plate 68 has a tapered passage 78 leading to the discharge passage 20. A quick release clamp mechanism generally identified by the reference numeral 80 is provided for releasably clamping the orifice plate 68 and the main body portion 66 of the housing together. Lugs 82 project outwardly from the main body portion 66 of the housing. The quick release clamping mechanisms 80 each consists of a stud 84, locking nuts 88 and a clamping ring 86. The clamping ring 86 is supported by the stud 84 and locking nuts 88 for rotation between a clamping position shown in FIG. 1 of the drawings and a release position as will be described hereinafter.

Figure 5:
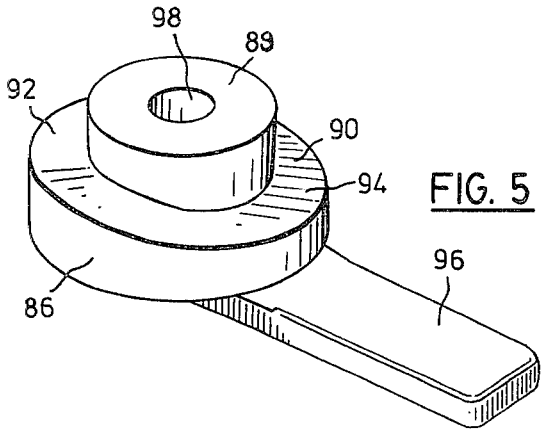
FIG. 5 is a pictorial view of a quick releasing clamping member.

As shown in FIG. 5 of the drawings, each clamping ring 86 is formed with a central boss 89 and a cam surface 90 extending circumferentially thereof. The cam surface 90 has an elevated section 92 and a lower section 94. An actuator handle 96 projects radially outwardly from the clamping ring 86 to facilitate rotation thereof. A passage 98 opens through the clamping ring 86 to receive the stud 84.

One of the studs 84 is a longitudinally elongated stud which has a projection 84*a*. An orifice plate mounting and release mechanism 100 is pivotably mounted on the extension 84*a*. The mechanism 100 includes a tubular sleeve 102 which has flanges 104 and 106 located at opposite ends thereof. The flange 104 underlies and supports the orifice plate 68 and is clamped between the orifice plate 68 and the clamping rings 86 in use. A pair of arms 108 project radially outwardly from the tubular member 102 and have a bearing member 110 extending therebetween. The bearing member 110 has a passage 112 for receiving the extension 84*a* of the stud 84. The spacer 114 is located adjacent the outer ends of the arms 108.

In use, in order to vary the specific gravity of separation of the stream flowing through the separator, it is merely necessary to adjust the height of the cap 14 by means of the adjustment nuts 60 and 62. It will be noted that by raising and lowering the cap 14, the relative position of the cap portion and the integrally formed vortex finder is not changed with the result that there is no change in the efficiency of operation of the cap.

In order to replace the orifice plate 68, it is merely necessary to rotate the quick release clamping mechanism 80, remove the two shorter studs 84 and pivot the support mechanism 100 about the extension 84*a* of the longer stud. By this mechanism the orifice plate 68 can be quickly and efficiently removed and replaced by a new orifice plate as required in use.

In use, a stream of particle bearing fluid is admitted to the separator chamber 16 by way of the input passage 18. A portion of the stream bearing the heavy fraction of the particulate material is discharged through the first discharge passage 20 and a further portion of the stream bearing the light particulate material is discharged upwardly through the passage 48 in the vortex finder into the chamber 40 of the cap wherein its velocity is reduced prior to discharge through the third discharge passage 42. In order to adjust the specific gravity of separation of the apparatus, it is merely necessary to adjust the height of the vortex finder as previously described. The adjustment of the height of the vortex finder does not affect the relative position of the outer end of the vortex finder with respect to the chamber 40 which is formed within the cap, with the result that the cap continues to operate efficiently to reduce the velocity of the overflow passing through the vortex finder, thereby preventing the siphoning of the separator chamber through the vortex finder.

These and other advantages of the apparatus of the present invention will be apparent to those skilled in the art.

What we claim as our invention is:

1. A cyclone separator for separating light and heavy fractions in a liquid-borne stream of particles comprising;

(a) a housing having a separator chamber formed therein, an input passage opening into said separator chamber and a first discharge passage opening from said separator chamber for discharging the heavy fraction, (b) a vortex finder having an inner end and an outer end, a second discharge passage opening through said vortex finder between the inner and outer ends thereof for conveying the light fraction from said separator chamber, (c) a cap having a second chamber formed therein, said second chamber having a bottom wall disposed above said housing and a third discharge passage opening outwardly from said second chamber for discharging the light fraction, (d) said vortex finder being movably mounted in said housing with its inner end disposed within said separator chamber in a spaced relationship with said first discharge passage to form a vortex throat therebetween, said vortex finder being movable relative to said housing to determine the size of said vortex throat and thereby determine the specific gravity of separation of the separator, (e) said cap being fixed with respect to said vortex finder for movement with said vortex finder relative to said housing when the vortex finder is moved to regulate the specific gravity of separation, said second discharge passage of said vortex finder opening at the outer end thereof into said second chamber of said cap, said vortex finder extending into said second chamber and having its outer end disposed a substantial distance above said bottom wall, said second chamber being proportioned and arranged with respect to the outer end of said vortex finder to reduce the velocity of the light fraction before it is discharged through the third discharge passage, and (f) adjustment means engaging said cap and said housing, said adjustment means being operable to move said cap relative to said housing thereby to effect adjustment of the specific gravity of separation, (g) said housing comprising, a main body portion and an orifice plate, said first discharge passage being formed in said orifice plate, said orifice plate having a tapered passage leading to said first discharge passage, said orifice plate and said main body portion having oppositely disposed abutting end faces, one of which is formed with an annular recess and the other of which is formed with a complementary annular ridge, the ridge being proportioned and arranged to be seated in the recess when the orifice plate and main body portion are operably aligned, (h) quick release clamping means comprising a plurality of support shafts each having one end mounted on said main body at spaced apart intervals thereabout, said shafts being disposed laterally outwardly from the orifice plate and each having a clamping cam mounted for rotation at the other end thereof, each clamping cam having an elevated clamping face and lowered face, said clamping cam being rotatable about its support to selectively locate the elevated or lowered clamping face in a position underlying the orifice plate to respectively clamp and release the orifice plate with respect to said main body.

2. A cycline separator as claimed in claim 1 further comprising an orifice plate support collar, support means for supporting said collar on said main body portion, said support means being pivotably mounted on one of said support shafts for movement relative to said main body portion to move said collar in an arc about said one support shaft from a first position supporting said orifice plate in operative alignment with said main body portion and a second position disposed remote from said first position to permit said orifice plate to be removed from said collar.

* * * * *